US005753102A

United States Patent [19]

Funakoshi et al.

[11] Patent Number: 5,753,102

[45] Date of Patent: May 19, 1998

[54] PROCESS FOR RECOVERING ORGANIC SULFUR COMPOUNDS FROM FUEL OIL

[75] Inventors: Izumi Funakoshi, 786, Ryutoku, Miyada-machi, Kurate-gun, Fukuoka-ken 823; Tetsuo Aida, Iizuka, both of Japan

[73] Assignee: Izumi Funakoshi, Fukuoka-ken, Japan

[21] Appl. No.: 538,370

[22] Filed: Oct. 3, 1995

[30] Foreign Application Priority Data

Nov. 11, 1994 [JP] Japan ..... 6-301607
Nov. 11, 1994 [JP] Japan ..... 6-301608

[51] Int. Cl.[6] ..... C10G 21/06; C10G 21/16

[52] U.S. Cl. ..... 208/208 R; 208/236; 208/240; 208/242; 208/237; 208/238

[58] Field of Search ..... 208/208 R, 236, 208/240, 242, 237, 238

[56] References Cited

U.S. PATENT DOCUMENTS

| | | | |
|---|---|---|---|
| 2,285,696 | 6/1942 | Dunn | 208/211 |
| 2,792,332 | 5/1957 | Hutchings | 208/240 |
| 4,013,549 | 3/1977 | Bushnell | 208/323 |
| 5,145,562 | 9/1992 | Brown et al. | 585/860 |
| 5,302,279 | 4/1994 | Degnan et al. | 208/87 |
| 5,494,572 | 2/1996 | Horii et al. | 208/263 |
| 5,582,714 | 12/1996 | Forte | 208/237 |

FOREIGN PATENT DOCUMENTS

| | | |
|---|---|---|
| 0439905 | 8/1991 | European Pat. Off. . |
| 0538738 | 4/1993 | European Pat. Off. . |
| 0653477 | 5/1995 | European Pat. Off. . |
| 56-49791 | 6/1981 | Japan . |
| 4-72387 | 6/1992 | Japan . |
| 2095279 | 9/1982 | United Kingdom . |

OTHER PUBLICATIONS abstract "Extraction of Sulphoxides from hydrocarbon mixtures". Author:Bondarenko et al., Aug. 23, 1991.

*Primary Examiner*—Walter D. Griffin
*Assistant Examiner*—Nadine Preisch
*Attorney, Agent, or Firm*—Browdy and Neimark

[57] ABSTRACT

The present invention provides a process and equipment for efficiently and economically recovering organic sulfur compounds in a fuel oil while maintaining the original chemical structures thereof. The fuel oil is admixed with a solvent low in solubility therein of hydrocarbons and high in solubility therein of organic sulfur compounds to effect migration of the organic sulfur compounds in the fuel oil into the solvent by making much of the nucleophilic properties of a lone pair of electrons on a bivalent sulfur atom of a sulfur-containing functional group, followed by fuel oil-solvent separation by settling out or with a centrifugal force. Alternatively, a solvent having a boiling point not exceeding the boiling point of the fuel oil is added to the fuel oil, and the solvent and the fuel oil are then agitated and mixed together at a temperature of at most the boiling point of the solvent to effect migration of the organic sulfur compounds in the fuel oil into the solvent while lowering the viscosity of the fuel oil, followed by cooling of the fuel oil and the solvent to a temperature not exceeding room temperature and subsequent fuel oil-solvent separation by settling out or with a centrifugal force. Subsequently, the separated solvent is distilled to recover the organic sulfur compounds.

7 Claims, 5 Drawing Sheets

PROCESS FOR RECOVERING ORGANIC SULFUR COMPOUNDS FROM FUEL OIL

BACKGROUND OF THE INVENTION

1. Field of the Invention

The present invention relates to a process for recovering organic sulfur compounds from a fuel oil containing organic sulfur compounds, such as light oil, heavy oil or bottoms, and equipment therefor.

2. Description of the Prior Art

Liquid oils respectively obtained from petroleum, oil sand, oil shale and coal contain various organic sulfur compounds. For example, sulfur contained in a fuel oil for use in a diesel engine has recently attracted attention as one of the causes of environmental pollution. Accordingly, there is an urgent need of development of an effective desulfurization technology. Thus, organic sulfur compounds contained in an oil have heretofore been so highly regarded as harmful substances that development of technologies with an eye to removing them has been made.

Since crude oil available worldwide has become more and more heavy, heavy oil fractions such as bottoms in particular are produced as by-products in large amounts after useful light oil fractions are collected. In bottoms, sulfur, nitrogen and metals are concentrated to high concentrations. Methods of increasing the light oil content of bottoms include hydrocracking of bottoms and fluid catalytic cracking of bottoms. When bottoms having a high sulfur content are used as such in those methods, however, sulfur acts as a catalyst poison and causes air pollution. In view of the above, a method of removing sulfur from bottoms is important.

In general, hydrogen-reducing desulfurization is now adopted as a method of removing sulfur from a fuel oil. According to the mainstream technology, a fuel oil is reacted with hydrogen gas in the presence of a catalyst under drastic conditions involving a high temperature and a high pressure to convert organic sulfur compounds into toxic hydrogen sulfide, which is separated from the fuel oil. As for heavy oil and bottoms, a fuel oil is catalytically treated under a pressure of hydrogen in substantially the same manner to convert sulfur compounds in the fuel oil into hydrogen sulfide, which is removed from the fuel oil. In general, conditions adopted in the hydrogen-reducing desulfurization of bottoms involve a reaction pressure of at least 100 $kg/cm^2$, preferably 100 to 170 $kg/cm^2$, a reaction temperature of at least 300° C., preferably 350° to 450° C., and a hydrogen/starting bottoms ratio of 100 to 2000 NI/NI. Examples of the catalyst to be used include oxides of expensive active metals such as nickel, cobalt, molybdenum, vanadium, and tungsten.

Another method of removing sulfur from a fuel oil is disclosed in Japanese Patent Laid-Open No. 72,387/1992. This method of removing sulfur from a fuel oil comprises treating a fuel oil obtained from petroleum, liquefied coal oil or the like with an oxidizing agent to raise the boiling points of organic sulfur compounds contained in the fuel oil, and separating and removing them from the fuel oil.

On the other hand, a technology of refining heavy coal oil using a solvent is disclosed in Japanese Patent No. 49,791/1981. This method of refining heavy coal oil comprises blending heavy coal oil with a ketone solvent, removing an insoluble precipitate formed in the resulting liquid mixture, and separating the ketone solvent from the liquid mixture.

According to the hydrogen-reducing desulfurization, however, organic sulfur compounds contained in a large amount in gas oil, fuel oil or bottoms involve a difficulty in desulfurization thereof. Since hydrogen-reducing desulfurization is hardly effective against chemically stable functional groups such as benzothiophene and dibenzothiophene derivatives in particular, there is an urgent need of development of a technology of desulfurizing gas oil to a sulfur content of at most 0.05% through increases in reaction temperature and pressure, improvements in the activity and function of a catalyst, etc. Higher reaction temperature and pressure are necessary in order to attain a high degree of desulfurization. When the reaction temperature is raised, however, coke is liable to be formed, leading to such occlusion with coke of the micropores of a catalyst as to bring about a decrease in the activity of the catalyst. Thus, in order to make up for the decrease in the activity of the catalyst, the reaction temperature must be further raised. In this case, it is known that the properties of a fraction having a boiling point of at least 360° C. in particular among the resulting products are deteriorated.

A difficulty in desulfurization according to hydrogen-reducing desulfurization is due to similarities in physical and chemical properties between organic sulfur compounds and hydrocarbons contained in a fuel oil. In order to effect degradation of chemically stable functional groups such as benzothiophene and dibenzothiophene derivatives existing in a large amount in the fuel oil, higher pressure and higher temperature conditions are required. In order to recover the organic sulfur compounds contained in the fuel oil while maintaining the original chemical structures thereof, there is a need of development of a method wherein a means for either a chemical change involving a high temperature, a pressure, a light and/or the like, or a chemical reaction such as oxidation or reduction is dispensed with becomes necessary.

Since sulfur contained in the form of organic sulfur compounds in the fuel oil has hitherto been strongly recognized as a harmful substance, progress has been made in development of technologies with an eye to decomposition of the organic sulfur compounds for removal of sulfur according to the foregoing hydrogen-reducing desulfurization wherein the organic sulfur compounds are converted into highly toxic hydrogen sulfide. These technologies lack the idea of recovering organic sulfur compounds in a fuel oil while maintaining the original chemical structures thereof in order to effectively utilize such organic sulfur compounds contained in the fuel oil.

In general, the organic sulfur compounds contained in a large amount in gas oil, fuel oil or bottoms have hitherto been strongly recognized as harmful substances. The reasons for this include an environmental problem ensuing from combustion of a fuel oil as such, and the fact that sulfur is a substance causative of catalyst poisoning in refining and processing the fuel oil. However, the organic sulfur compounds contained in the fuel oil can be given a position as one group of organic sulfur compounds which have recently gradually attracted attention as industrial starting materials, and are therefore valuable resources promising a great contribution to the human society in the near future. For example, benzothiophene and dibenzothiophene derivatives involving a difficulty in hydrodesulfurization thereof due to the chemical stabilities thereof have a potential of useful industrial starting materials. If such derivatives are to be produced from sulfur as an inorganic substance, a complicated chemical process and a considerable production cost are necessary.

In order to collect organic sulfur compounds from a fuel oil while maintaining the original chemical structures thereof with a view to effectively utilizing the organic sulfur compounds, hydrogen-reducing desulfurization is inapplicable. The recovery of the organic sulfur compounds from the fuel oil is equal to desulfurization of the fuel oil. From the viewpoint of desulfurization as well, the foregoing hydrogen-reducing desulfurization involves an operation to be carried out under a high pressure at a high temperature, thus necessitating a large investment in facilities and a high level of control technology for a stable run of equipment and involving consumption of a catalyst made of an expensive rare metal as well as supply and consumption of a large amount of hydrogen. Accordingly, there is a need of development of a process which relies neither upon factors such as a high temperature (temperature), a high pressure (pressure) and a light involved in a chemical change, nor upon a means for a chemical reaction such as oxidation or reduction.

SUMMARY OF THE INVENTION

An object of the present invention is to provide process and equipment for recovery of organic sulfur compounds from a fuel oil such as light oil, heavy oil or bottoms; wherein organic sulfur compounds can be simply and economically recovered, or removed through desulfurization, from a fuel oil with a high recovery efficiency while maintaining the original chemical structures of the organic sulfur compounds as contained in the fuel oil without resort to not only increases in the temperature and pressure of the fuel oil but also supply of consumption materials such as a catalyst and hydrogen.

The present invention provides a process for recovering organic sulfur compounds from a fuel oil: comprising admixing a fuel oil containing organic sulfur compounds, such as light oil and/or heavy oil, with a solvent low in solubility therein of hydrocarbons and high in solubility therein of organic sulfur compounds to effect migration of the organic sulfur compounds contained in the fuel oil into the solvent; then separating the solvent containing the organic sulfur compounds from the liquid mixture of the fuel oil and the solvent through settling out, osmosis, filtration and/or centrifugal separation; and subsequently evaporating the solvent to recover the organic sulfur compounds as the evaporation residue.

The present invention also provides a process for recovering organic sulfur compounds from a fuel oil: comprising adding a solvent having a boiling point not exceeding the boiling point of a fuel oil such as bottoms and/or heavy oil to the fuel oil; agitating and mixing the fuel oil and the solvent at a temperature not exceeding the boiling point of the solvent to effect migration of organic sulfur compounds contained in the fuel oil into the solvent while lowering the viscosity of the fuel oil; subsequently cooling the liquid mixture of the fuel oil and the solvent to a temperature not exceeding room temperature to effect separation of the solvent containing the organic sulfur compounds from the fuel oil; and further subjecting the solvent containing the organic sulfur compounds to distillation to recover the organic sulfur compounds from the solvent.

The above-mentioned solvent is either a single substance or a plurality of substances selected from the group consisting of acetone, pinacolin, mesityl oxide, acetophenone, benzophenone, acetylacetone, 2-butanone, methanol, ethanol, propanols, butanols, acetonitrile, propionitrile, butyronitrile, nitromethane, nitroethane, nitropropanes, nitrobenzenes, dimethyl sulfoxide, N,N'-dimethylformamide, N,N'-dimethylacetamide, pyridine, N-methylpyrrolidinone, trimethyl phosphate, triethyl phosphate, hexamethylphosphoramide, and phospholan; or a mixture of such a substance(s) with water incorporated thereinto in a concentration of at most 20% and/or an acid or iodine incorporated thereinto in a concentration of at most 10%.

The feature of the present invention is that the organic sulfur compounds contained in the fuel oil such as light oil and/or heavy oil are dissolved in the solvent and separated from the fuel oil by making much of the nucleophilic properties of the organic sulfur compounds to change the solubility thereof as one of the innate physical properties thereof.

The term "light oil" encompasses naphtha, gasoline, kerosine, and straight-run light gas oil. The term "heavy oil" encompasses straight-run heavy gas oil (HGO), fuel oil, vacuum-distilled gas oil (VGO), oils respectively extracted from Orinoco crude oil, oil sand, tar sand and oil shale, and sulfur-containing tarry heavy oil such as a primary product of liquefied coal oil.

"Bottoms" include bottoms obtained through atmospheric or vacuum distillation of crude oil, bottoms obtained through atmospheric or vacuum distillation of crude oil extracted from oil sand or tar sand, mixtures thereof, and coal tar.

The solvent to be used is required to have a weak dissolving power for hydrocarbons and a strong dissolving power for organic sulfur compounds, i.e., a high selectivity. Further, in separation of the organic sulfur compounds, the solvent is desired to have a large difference in density from the starting material, so high a surface tension as hardly to cause emulsification, and so large a difference in boiling point from the desired component to form no azeotrope.

The solvent to be used in the present invention is a polar solvent. A strongly electron-donative solvent exhibits a high capability of extracting organic sulfur compounds as demonstrated in Examples. An aprotic dipolar solvent such as acetone rather than alcohols is used for chemical functional groups existing in a large amount in gasoline, kerosine, gas oil and bottoms because it shows a high partition coefficient. An important constituent feature of the present invention is that an alcohol solvent, water and/or an acid selected from the group consisting of organic carboxylic acids, sulfonic acids, sulfuric acid, nitric acid and hydrochloric acid, or iodine is added to the above-mentioned strongly electron-donative solvent to change the innate solubility of the organic sulfur compounds to thereby increase the selectivity of the solvent for the organic sulfur compounds existing in the liquid oil by making much of the fact that a lone pair of electrons on a bivalent sulfur atom of a sulfur-containing functional group have strong nucleophilic properties.

As will be illustrated in Examples in particular, a remarkable effect can be secured in the case where acetone among others is used as the solvent and admixed with at most 5%, based on acetone, of water. In this case, the solvent and water are easily mixed with light oil by agitation and/or vibration to effect immediate migration of the organic sulfur compounds in light oil into the solvent. Addition of water and/or an acid increases the cohesive energy of the solvent to enlarge a difference in cohesive energy between the liquid oil and the solvent containing the organic sulfur compounds. This allows droplets of the solvent containing the organic sulfur compounds to naturally begin, upon termination of agitation or vibration, to separate from droplets of light oil, thus forming respective aggregates. In the case of heavy oil, mixing thereof with the solvent is advantageously effected by a shearing agitation operation. Further, the viscosity of heavy oil may be lowered by preliminarily adding thereto kerosine, gas oil, mesityl oxide or 2-butanone, whereby the migration of the organic sulfur compounds can be enhanced.

In the process for recovering organic sulfur compounds from a fuel oil such as bottoms and/or heavy oil, bottoms or heavy oil mixed with the solvent is also depressed in viscosity or liquefied in the temperature range of at most the boiling point of the solvent.

On the other hand, the fuel oil such as light oil and/or heavy oil in the mixed solution of the fuel oil and the solvent can be separated from the solvent containing the organic sulfur compounds by cooling the mixed solution of the fuel oil and the solvent to enlarge a difference in cohesive energy between the fuel oil and the solvent containing the organic sulfur compounds to thereby coagulate and aggregate the fuel oil.

The foregoing process for recovering organic sulfur compounds from light oil and/or heavy oil is also applicable to recovery of organic sulfur compounds contained in an oily substance obtained by dry distillation of coal tar, i.e., an aromatic compound such as naphthalene, phenol, naphthol, anthracene, or phenanthrene.

As for a problem with separation due to not so large a difference in density between the solvent used and the liquid oil, the oil-solvent separation is preliminarily allowed in the foregoing manner to proceed, and centrifugal liquid-liquid separation is then applied to the foregoing process for recovering organic sulfur compounds from light oil and/or heavy oil with attention focused on the fact that an up-to-date centrifugal separator is capable of liquid-liquid separation even in the case where a difference in density between liquids is in the range of 0.1 to 0.03.

The solvent to be used is not required to have a viscosity-depressant effect at an ordinary temperature (20° C.) for a fuel oil such as high-viscosity bottoms or heavy fuel oil. More specifically, an important constituent feature of the present invention is that such a fuel oil is temporarily swollen and depressed in viscosity to effect mutual dissolution of the fuel oil and the solvent only when the fuel oil and the solvent are agitated and mixed together, while the fuel oil is separated from the solvent when the operation of agitation is stopped. Thus, a decrease in the viscosity of the fuel oil depends not only on the kind of solvent chosen, but also on the temperature of the fuel oil and the shearing, dispersing and mixing capabilities of an agitator. The solvent separated after mixing of the fuel oil with the solvent at a temperature not exceeding the boiling point of the solvent and subsequent cooling thereof to a temperature not exceeding an ordinary temperature (20° C.) is distilled off and cooled to be ready for reuse, while the organic sulfur compounds in the distillation residue are concentrated and separated.

Meanwhile, entrainment of at least a few percents of oil and/or tar in the solvent is unavoidable in the step of migration of the organic sulfur compounds in bottoms or heavy oil into the solvent. In view of the above, oil and/or tar may be removed from the recovered solvent containing the organic sulfur compounds and having oil and/or tar dissolved therein with a centrifugal separator. In this case, addition of a few percents of water and/or an acid, and/or cooling of the recovered solvent promotes the separation of oil and/or tar.

The present invention further provides equipment for recovering organic sulfur compounds from a fuel oil: comprising a mixing tank for mixing a fuel oil such as light oil and/or heavy oil with a solvent and an additive selected from water and/or acids and iodine to prepare a liquid mixture; a separator for separating the fuel oil from the solvent containing organic sulfur compounds by subjecting the liquid mixture prepared in the mixing tank to centrifugal separation and/or settling out or osmotic separation; and a solvent-distilling tank for evaporating the separated solvent containing the organic sulfur compounds to separate and recover the solvent and the organic sulfur compounds.

The present invention still further provides equipment for separating and recovering organic sulfur compounds from a fuel oil: comprising a reaction tank for mixing bottoms or heavy oil with a solvent and an additive for the solvent selected from water and/or acids while heating them to prepare a liquid mixture; a separation unit for cooling the liquid mixture prepared in the reaction tank to separate oil from the solvent containing organic sulfur compounds; a centrifugal separator for removing and discharging tar from the separated solvent containing the organic sulfur compounds; and a separated solvent-distilling tank for evaporating the solvent containing the organic sulfur compounds and stripped of tar with the centrifugal separator to separate and recover the solvent and the organic sulfur compounds.

According to the present invention, separation (extraction) and recovery (desulfurization from the standpoint of the fuel oil) of the organic sulfur compounds are effected through material transfer by selecting the solvent low in solubility therein of hydrocarbons and high in solubility therein of organic sulfur compounds in combination with effective extraction and separation methods without resort to not only a chemical change involving a high temperature, a high pressure, a light and/or the like but also a means for a chemical reaction such as reduction or oxidation on the basis of the fact that the organic sulfur compounds selectively migrate into the solvent low in solubility therein of hydrocarbons and high in solubility therein of the organic sulfur compounds because a fuel oil such as light oil and/or heavy oil containing organic sulfur compounds is such that the organic sulfur compounds as solutes are dissolved in the fuel oil as a sort of solvent. More specifically, a feature of the present invention is that the solubility of the organic sulfur compounds as one of the innate physical properties thereof is changed by making much of the nucleophilic properties of the organic sulfur compounds while at the same time enlarging a difference in cohesive energy between the fuel oil and the solvent containing the organic sulfur compounds, whereby the organic sulfur compounds can be dissolved out and separated from the fuel oil.

In the present invention, the viscosity of bottoms or heavy oil is quickly lowered between temperatures of 30° and 100° C., and the temperature at which the viscosity of the fuel oil becomes such that an operation of agitation of the fuel oil with an agitator is possible is around 35° to 45° C. On the basis of the foregoing facts, the solvent high in solubility therein of the organic sulfur compounds contained in the fuel oil is selected and admixed with the fuel oil with agitation at a temperature not exceeding the boiling point of the solvent to temporarily depress the viscosity of the fuel oil only during agitation to thereby effect efficient migration of the organic sulfur compounds present in the fuel oil into the solvent. In other words, the process of the present invention for recovering organic sulfur compounds from a fuel oil is a method of recovering organic sulfur compounds in a fuel oil through material transfer, and can be applied to desulfurization of a fuel oil for removal therefrom of organic sulfur compounds.

According to the present invention, the organic sulfur compounds contained in the fuel oil such as light oil and/or heavy oil can be recovered therefrom using simple facilities with a high efficiency and at a low cost, while maintaining the original chemical structures of the organic sulfur compounds as contained in the fuel oil. The recovered organic sulfur compounds can be used as industrially useful resources in the field of manufacturing drugs, agricultural chemicals, heat-resistant resin, etc. The process of the present invention for recovering organic sulfur compounds from a fuel oil can also be applied to desulfurization of a fuel oil for removal therefrom of organic sulfur compounds, in which case desulfurization can be effected using simple facilities according to a simple procedure which does not require a high temperature and a high pressure, and involves a little energy consumption and no formation of coke without resort to reduction with hydrogen, thus producing a remarkable economic effect.

According to the present invention, the organic sulfur compounds contained in bottoms or heavy oil can be recovered using simple facilities at a high efficiency and at a low cost while maintaining the original chemical structures of the organic sulfur compounds as contained in the fuel oil. Further, the recovered organic sulfur compounds can be used as industrially useful starting materials in the field of manufacturing drugs, agricultural chemicals, heat-resistant resins, etc.

From the standpoint of desulfurization of bottoms or heavy oil for recovery of bottoms or heavy oil stripped of organic sulfur compounds, the present invention provides simple recovery process and equipment therefor wherein use is made of simple facilities. The process of the present invention is a desulfurization method wherein the step of recovering organic sulfur compounds from bottoms or heavy oil requires neither heat-up of the fuel oil to a high temperature nor pressurization of the fuel oil to a high pressure, and involves a little energy consumption and no formation of coke without resort to reduction with hydrogen, thus producing a remarkable economic effect.

DETAILED DESCRIPTION OF THE EMBODIMENTS

Figure 1:
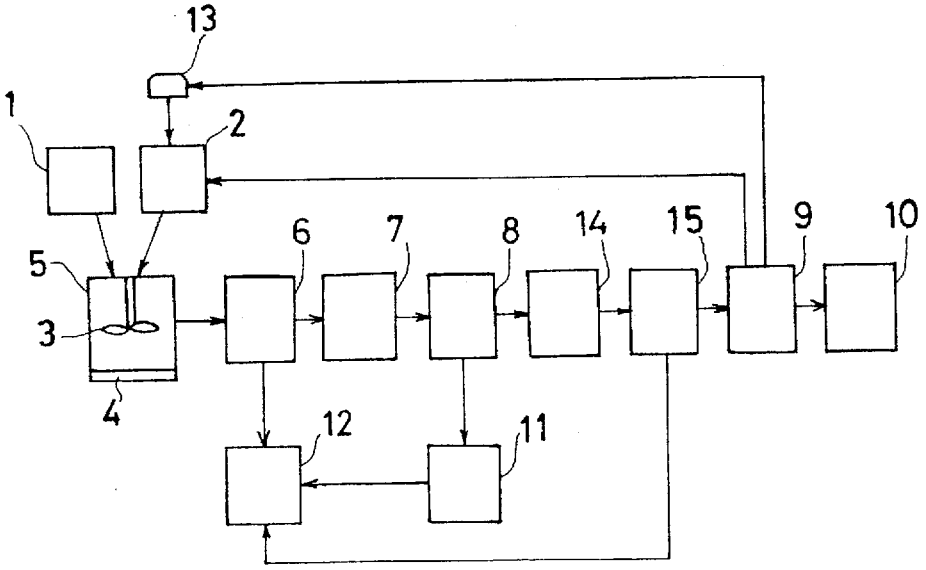
FIG. 1 is a system diagram showing an example of recovery equipment for carrying out the process for recovering organic sulfur compounds from bottoms or heavy oil according to the present invention.

The process and equipment for recovering organic sulfur compounds from bottoms or heavy oil according to the present invention will now be illustrated while referring to FIG. 1.

In the process for recovering organic sulfur compounds from bottoms or heavy oil, an additive is first fed into a solvent tank 2 from an additive tank 13, while a solvent admixed with the additive is fed into a reaction tank 5 from the solvent tank 2. On the other hand, bottoms or heavy oil is fed into the reaction tank 5 from a tank 1 containing bottoms or heavy oil. Bottoms or heavy oil and the solvent fed into the reaction tank 5 are agitated with an agitator having a function of shearing and dispersion while simultaneously heating them with a heater 4 to prepare a liquid mixture wherein bottoms or heavy oil is swollen and liquefied. Thereafter, the liquid mixture is transferred to a resting tank 6. The solvent containing the organic sulfur compounds and separated in the upper layer of the resting tank 6 from the liquid mixture is transferred to a separated solvent tank 7, while the desulfurized residual oil is transferred to a desulfurized residual oil tank 12. Subsequently, the separated solvent containing the organic sulfur compounds is stripped of tar with a centrifugal separator 8. The separated tar is discharged into a separated tar tank 11, while the solvent containing the organic sulfur compounds and stripped of tar is transferred to a separated solvent-distilling tank 9. The solvent containing the organic sulfur compounds is subjected to distillation with the separated solvent-distilling tank 9. The solvent recovered by distillation is returned to the solvent tank 2, and the additive recovered by distillation is returned to the additive tank 13, while the distillation residue is recovered as the organic sulfur compounds in a recovered organic sulfur compounds tank 10. On the other hand, the amount of oil included in the organic sulfur compounds recovered as the distillation residue can be decreased by cooling the solvent containing the organic sulfur compounds and stripped of tar with the centrifugal separator in a cooling tank 14 to coagulate oil dissolved in the solvent, further separating the oil with a centrifugal separator 15, and feeding the separated oil into the desulfurized residual oil tank 12. Meanwhile, the additive may alternatively be fed either into the reaction tank 5 wherein bottoms and/or heavy oil has already been mixed with the solvent, or into the cooling tank 14 containing the solvent.

Figure 2:
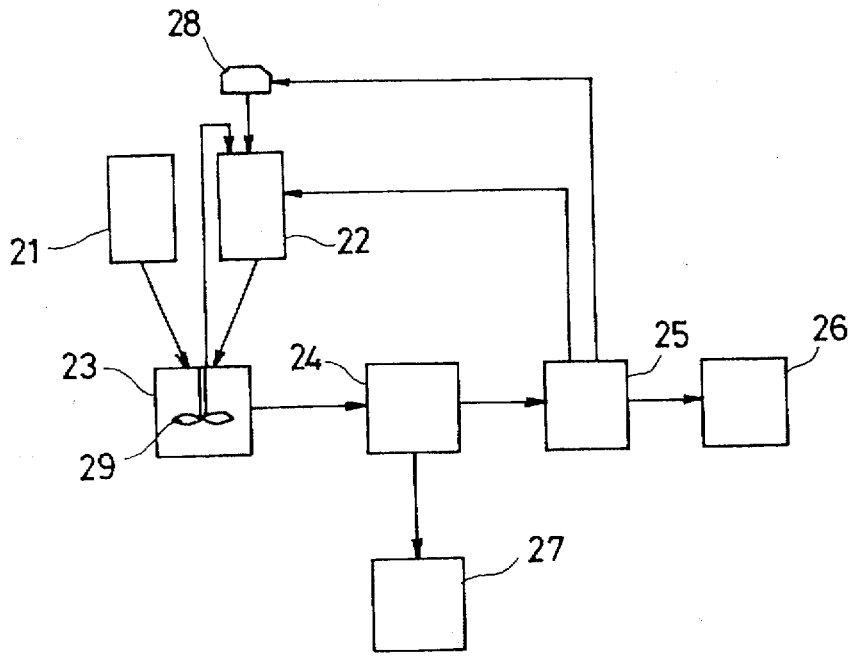
FIG. 2 is a system diagram showing another example of treatment equipment for carrying out the process for recovering organic sulfur compounds from light oil and/or heavy oil according to the present invention.

Next, the process and equipment for recovering organic sulfur compounds from light oil and/or heavy oil according to the present invention will now be illustrated while referring to FIG. 2.

In equipment for recovering organic sulfur compounds from a fuel oil such as light oil and/or heavy oil, an additive such as water and/or an acid is added to a solvent in a solvent tank 22 from an additive tank 28, and the solvent is then fed into a mixing tank 23, into which a liquid oil such as kerosine, gas oil and/or fuel oil is fed as light oil and/or heavy oil. In the mixing tank 23, the liquid oil and the solvent are agitated and mixed together with an agitator 29 to prepare a liquid mixture. Thereafter, the liquid mixture is separated into the liquid oil and the solvent containing the organic sulfur compounds with a centrifugal separator 24. The desulfurized liquid oil stripped of the organic sulfur compounds is transferred to a desulfurized liquid oil tank 27, while the solvent containing the organic sulfur compounds is fed into a distilling tank 25. Subsequently, the solvent containing the organic sulfur compounds is subjected to distillation in the distilling tank 25. The distilled solvent is returned to the solvent tank 22, while the distilled additive is returned to the additive tank 28. The organic sulfur compounds recovered as the distillation residue in the distilling tank 25 are recovered in a recovered organic sulfur compounds tank 26. A piping for recovering the volatilized solvent in the solvent tank 22 is provided between the top of the mixing tank 23 and the solvent tank 22 to enable the solvent volatilized by agitation with the agitator 23 to be recovered. The heat of the liquid mixture is lost in keeping with the volatilization by agitation of the solvent to lower the temperature of the liquid mixture to effect natural cooling of the liquid mixture, whereby oil dissolved in the solvent can be coagulated to promote the separation thereof with the centrifugal separator 24. The separation with the centrifugal separator 24 can alternatively be facilitated by warming light oil and/or heavy oil in the tank 21 to a temperature of about 50° C. to 60° C., mixing it with the solvent, and subsequently cooling the resulting mixture. In this case, the solvent containing the organic sulfur compounds can be separated from the oil without using the additive for the solvent.

The following description will be made of a variety of Examples of the process for recovering organic sulfur compounds from a fuel oil according to the present invention while referring to FIGS. 1 to 9 and Tables 1 to 7.

[EXAMPLE 1]

300 ml of gas oil (boiling point: 300° to 360° C., combustible sulfur content: 4,250 ppm) was fed into the mixing tank 23, to which 300 ml of acetone and 6 ml of water were added. They were agitated for 10 seconds with the propeller agitator 29 run at 300 rpm to prepare a liquid mixture. Thereafter, the liquid mixture was cooled to 5° C., and then subjected to centrifugal separation with the centrifugal separator 24 run at a rotational speed of 3,000 rpm to separate the liquid mixture into gas oil and the solvent containing organic sulfur compounds. After the foregoing procedure was repeated 6 times, 6 batches of the solvent containing the organic sulfur compounds were collected, and then subjected to distillation at a temperature of 60° C. to obtain the organic sulfur compounds as the distillation residue. The combustible sulfur content of the treated gas oil was 330 ppm, and the recovery of the organic sulfur compounds was 92.9% in terms of sulfur.

[EXAMPLE 2]

300 ml of gas oil (boiling point: 300° to 360° C., combustible sulfur content: 4,250 ppm) was fed into the mixing tank 23, to which 300 ml of acetone was added. They were agitated and mixed together for 60 seconds with the propeller agitator 29 run at 2,000 rpm to prepare a liquid mixture. Thereafter, the liquid mixture was cooled to −5° C., and then subjected to centrifugal separation with the centrifugal separator 24 run at a rotational speed of 3,000 rpm to separate the liquid mixture into gas oil and the solvent containing organic sulfur compounds. After the foregoing procedure was repeated 6 times, 6 batches of the solvent containing the organic sulfur compounds were collected, and then subjected to distillation at a temperature of 70° C. to obtain the organic sulfur compounds as the distillation residue. The combustible sulfur content of the treated gas oil was 360 ppm, and the recovery of the organic sulfur compounds was 91.5% in terms of sulfur.

[EXAMPLE 3]

300 ml of kerosine (boiling point: 220° to 300° C., combustible sulfur content: 45 ppm) was fed into the mixing tank 23, to which 30 ml of acetone, 270 ml of ethanol and 6 ml of water were added. They were agitated and mixed together for 10 seconds with the propeller agitator 29 run at 300 rpm to prepare a liquid mixture. Thereafter, the liquid mixture was cooled to 5° C., and then subjected to centrifugal separation with the centrifugal separator 24 run at a rotational speed of 3,000 rpm to separate the liquid mixture into kerosine and the solvent containing organic sulfur compounds. After the foregoing procedure was repeated 6 times, 6 batches of the solvent containing the organic sulfur compounds were collected, and then subjected to distillation at a temperature of 80° C. to obtain the organic sulfur compounds as the distillation residue. The combustible sulfur content of the treated kerosine was 6.2 ppm, and the recovery of the organic sulfur compounds was 86% in terms of sulfur.

[EXAMPLE 4]

300 ml of gas oil (boiling point: 300° to 360° C., combustible sulfur content: 4,250 ppm) was fed into the mixing tank 23, to which 280 ml of ethanol, 20 ml of mesityl oxide and 6 ml of water were added. They were agitated and mixed together for 20 seconds with the propeller agitator 29 run at 300 rpm to prepare a liquid mixture. Thereafter, the liquid mixture was cooled to 5° C., and then subjected to centrifugal separation with the centrifugal separator 24 run at a rotational speed of 3,000 rpm to separate the liquid mixture into gas oil and the solvent containing organic sulfur compounds. After the foregoing procedure was repeated 6 times, 6 batches of the solvent containing the organic sulfur compounds were collected, and then subjected to distillation at a temperature of 130° C. to obtain the organic sulfur compounds as the distillation residue. The combustible sulfur content of the treated gas oil was 550 ppm, and the recovery of the organic sulfur compounds was 87% in terms of sulfur.

[EXAMPLE 5]

300 ml of fuel oil A (boiling point: 360° C., combustible sulfur content: 6,280 ppm) was fed into the mixing tank 23, to which 120 ml of ethanol, 180 ml of acetone, 6 ml of water and 2 ml of formic acid were added. They were agitated and mixed together for 30 seconds with the propeller agitator 29 run at 1,000 rpm while heating them at 45° C. to prepare a liquid mixture. Thereafter, the liquid mixture was cooled to 5° C., and then subjected to centrifugal separation with the centrifugal separator 24 run at a rotational speed of 3,000 rpm to separate the liquid mixture into fuel oil A and the solvent containing organic sulfur compounds. After the foregoing procedure was repeated 7 times, 7 batches of the solvent containing the organic sulfur compounds were collected, and then subjected to distillation at a temperature of 80° C. to obtain the organic sulfur compounds as the distillation residue. The combustible sulfur content of the treated fuel oil A was 325 ppm, and the recovery of the organic sulfur compounds was 99.48% in terms of sulfur.

[EXAMPLE 6]

This Example shows the capabilities of various solvents in extracting organic sulfur compounds. The desulfurizability (recovery of organic sulfur compounds) of fuel oil (sulfur content: 6,200 ppm) with each of the various solvents was examined. 15 ml of fuel oil A and 15 ml of acetone were added to a 30 ml graduated cylinder with a stopper, and then agitated at intervals of 5 minutes for 30 minutes while applying thereto ultrasonic waves, followed by addition thereto of 0.15 ml of water and subsequent agitation. The resulting mixture was allowed to stand for a whole day and night. Thereafter, the fuel oil layer was collected, washed with water, and dried. Substantially the same procedure as described above was repeated except that acetone was replaced with each of N,N'-dimethylformamide (DMF), acetonitrile, trimethyl phosphate, nitromethane, methanol, hexamethylphosphoramide (HMPA), acetic acid, pyridine, and N-methylpyrrolidinone (NMP). The results of desulfurization (recovery of organic sulfur compounds) with each of the solvents are shown in terms of the sulfur content of the treated fuel oil in Table 1.

[EXAMPLE 7]

Figure 3:
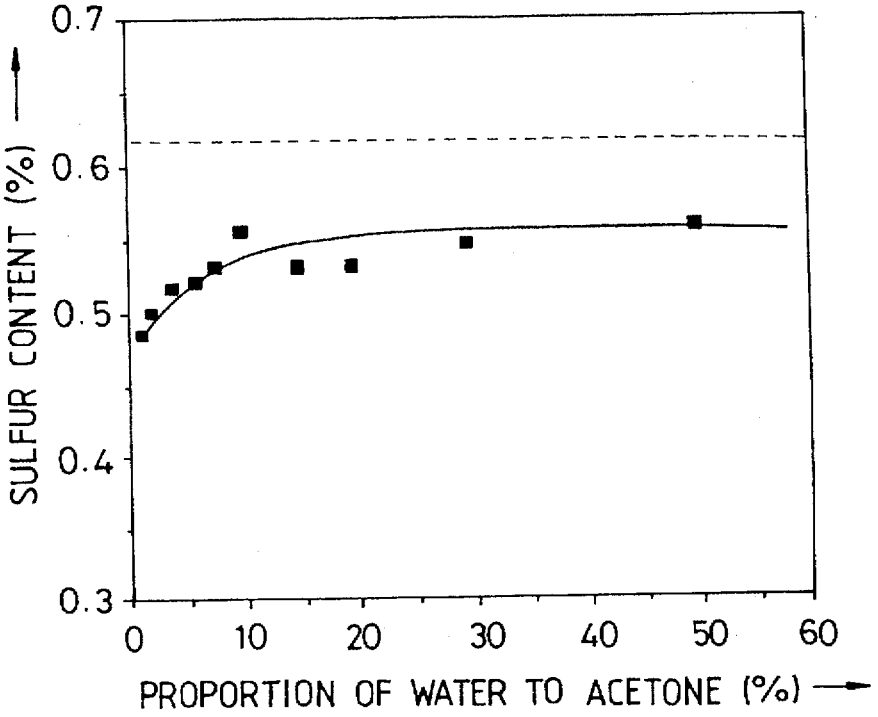
FIG. 3 is a graph showing the relationship between the proportion of water to acetone used as a solvent and the sulfur content of fuel oil.

When acetone was used as a solvent for recovery of organic sulfur compounds (desulfurization ) in fuel oil A (sulfur content: 6,200 ppm), the influence of the proportion of water to acetone was as shown in Table 2 and FIG. 3. It is understood that the lower the proportion of water to acetone, the more the organic sulfur compounds were recovered.

TABLE 1

| Extractant | Sulfur Content (ppm) |
|---|---|
| acetone | 4880 |
| DMF | 3840 |
| acetonitrile | 5480 |
| nitromethane | 5700 |
| trimethyl phosphate | 5710 |
| methanol | 6020 |
| HMPA | 3980 |
| acetic acid | 5340 |
| NMP | 3370 |
| pyridine | 5060 |

TABLE 2

| Proportion of Water to Acetone (%) | Sulfur Content (ppm) |
|---|---|
| 1 | 4480 |
| 2 | 5020 |
| 4 | 5180 |
| 6 | 5240 |
| 8 | 5340 |
| 10 | 5570 |
| 15 | 5330 |
| 20 | 5330 |
| 30 | 5490 |
| 50 | 5600 |

[EXAMPLE 8]

Figure 4:
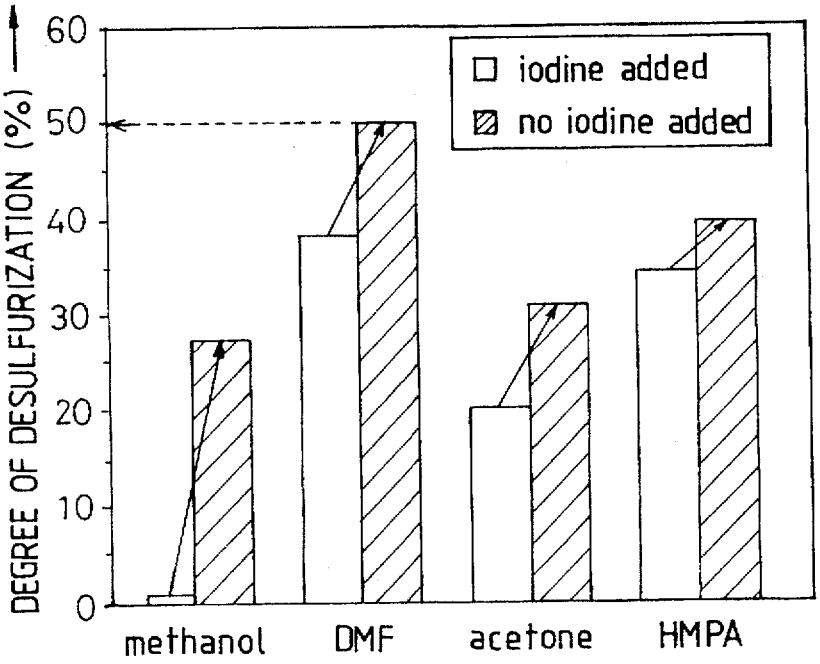
FIG. 4 is a graph showing degrees of desulfurization in heavy oil in cases where the process according to the present invention was carried out by adding iodine in combination with a variety of solvent.
Figure 5:
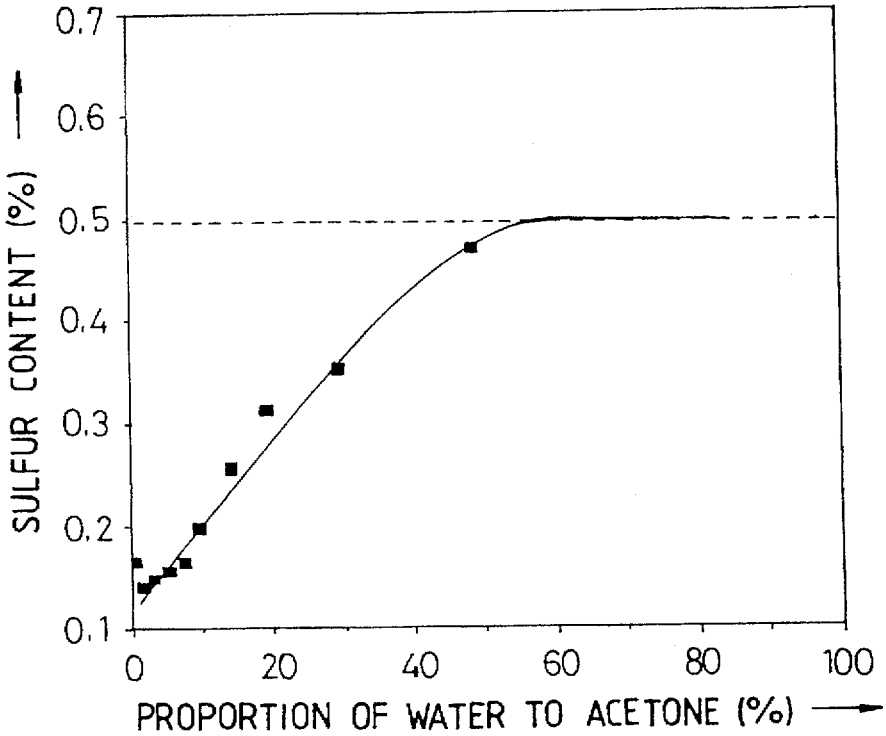
FIG. 5 is a graph showing the relationship between the proportion of water to acetone used as a solvent and the sulfur content of oxidized heavy oil.
Figure 6:
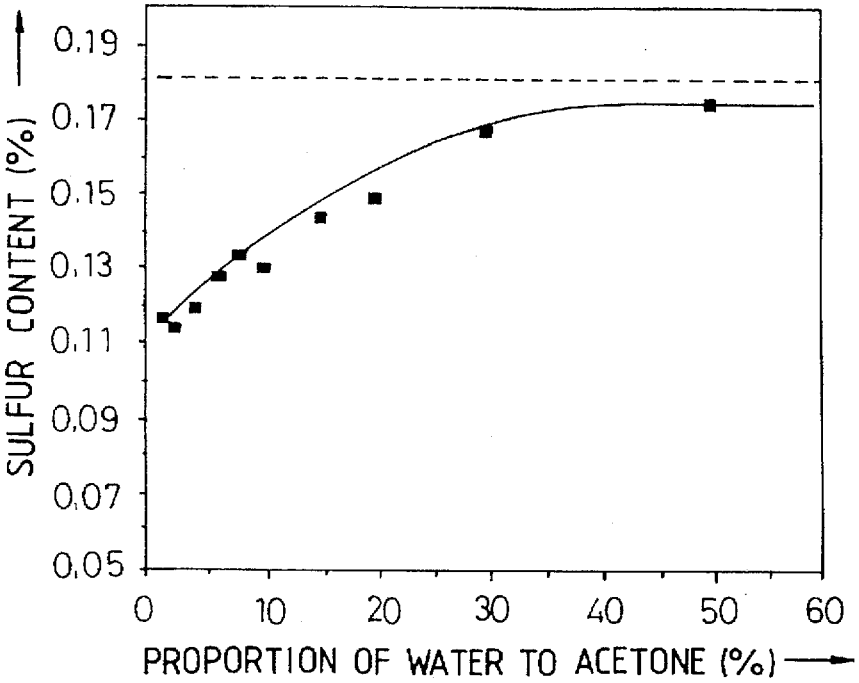
FIG. 6 is a graph showing the relationship between the proportion of water to acetone used as a solvent and the sulfur content of light oil.
Figure 7:
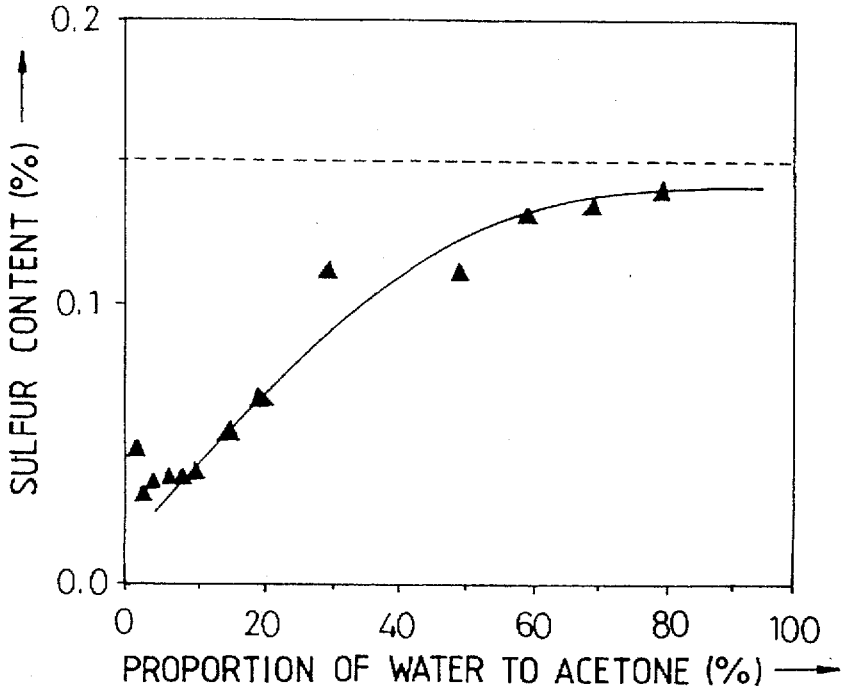
FIG. 7 is a graph showing the relationship between the proportion of water to acetone used as a solvent and the sulfur content of oxidized light oil.
Figure 8:
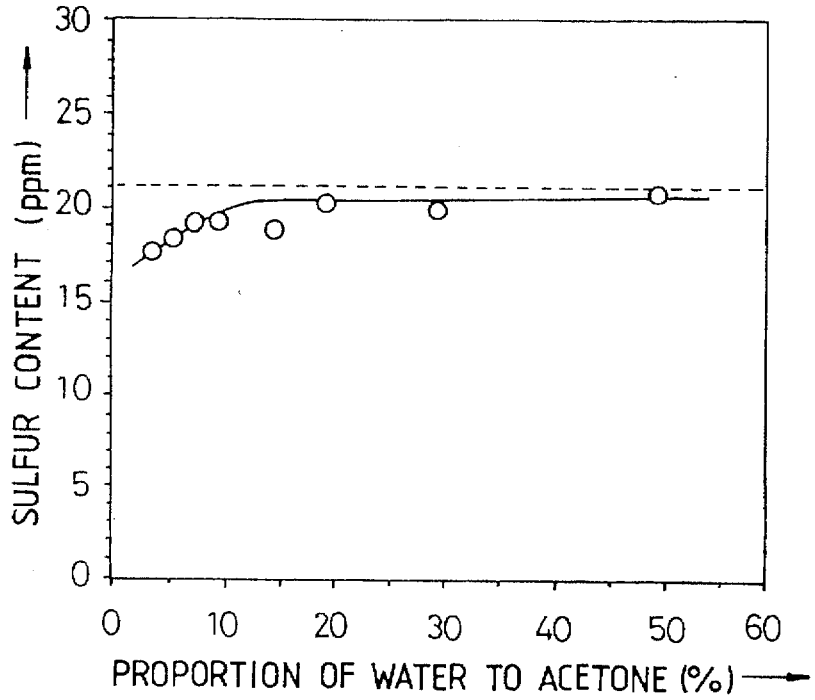
FIG. 8 is a graph showing the relationship between the proportion of water to acetone used as a solvent and the sulfur content of kerosine.
Figure 9:
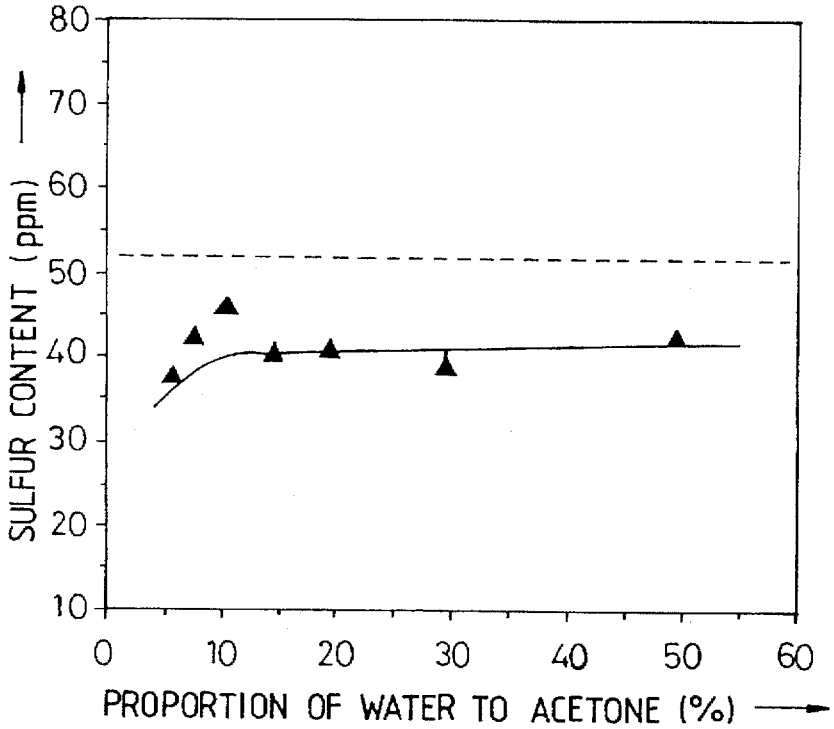
FIG. 9 is a graph showing the relationship between the proportion of water to acetone used as a solvent and the sulfur content of gasoline.

Substantially the same procedure of recovering the organic sulfur compounds from fuel oil A with each of various solvents as described in Example 6 was repeated except that 4.75 g of iodine having a stronger electron attractivity was added to each of various solvents. The resulting mixture after agitation was allowed to stand for a whole day and night. Thereafter, the fuel oil layer was collected, washed with an aqueous solution of sodium thiosulfate, washed with water, and dried. Degrees of desulfurization for the various solvents are shown in FIG. 4.

[EXAMPLE 9]

20 ml of formic acid and 20 ml of hydrogen peroxide were added to 200 ml of fuel oil A (sulfur content: 6,200 ppm), followed by vigorous agitation for 90 minutes. After the reaction, the fuel oil layer was separated, washed with water, allowed to cool, and dried. The resulting product (sulfur content: 5,000 ppm) was used to examine the influence of the proportion of water to acetone used as a solvent, which is shown in Table 3 and FIG. 5. It is apparent that the recovery of oxidized organic sulfur compounds was higher.

[EXAMPLE 10]

15 ml of gas oil (sulfur content: 1,800 ppm) and 15 ml of acetone were added to a 30 ml graduated cylinder with a stopper, and then agitated at intervals of 5 minutes for 30 minutes while applying thereto ultrasonic waves, followed by addition thereto of water and subsequent agitation. The resulting mixture was allowed to stand for a whole day and night. Thereafter, the gas oil layer was collected, washed with water, and dried. The relationship between the proportion of water to acetone and the recovery (desulfurization) is shown in Table 4 and
FIG. 6. It is understood that the smaller the amount of water added, the higher the effect in the same way as in the case of fuel oil A.

TABLE 3

| Proportion of Water to Acetone (%) | Sulfur Content (ppm) |
|---|---|
| 1 | 1670 |
| 2 | 1430 |
| 4 | 1510 |
| 6 | 1570 |
| 8 | 1670 |
| 10 | 2000 |
| 15 | 2600 |
| 20 | 3150 |
| 30 | 3560 |
| 50 | 4760 |

TABLE 4

| Proportion of Water to Acetone (%) | Sulfur Content (ppm) |
|---|---|
| 1 | 1170 |
| 2 | 1140 |
| 4 | 1190 |
| 6 | 1280 |
| 8 | 1340 |
| 10 | 1300 |
| 15 | 1440 |
| 20 | 1490 |
| 30 | 1670 |
| 50 | 1750 |

[EXAMPLE 11]

When acetone as the solvent was replaced with DMF in Example 10, the sulfur content of the treated gas oil was 993 ppm, and the recovery (desulfurization) was 44.8%.

[EXAMPLE 12]

When water to be added to acetone as the solvent was replaced with 4.75 g of iodine in Example 10, the sulfur content of the treated gas oil was 1,030 ppm, and the recovery (desulfurization) was 42.8%.

[EXAMPLE 13]

20 ml of formic acid and 20 ml of hydrogen peroxide were added to 200 ml of gas oil (sulfur content: 1,800 ppm), followed by vigorous agitation for 90 minutes. After the reaction, the gas oil layer was separated, washed with water, allowed to cool, and dried. The resulting product (sulfur content: 1,500 ppm) was used to examine the influence of the proportion of water to acetone used as a solvent, which is shown in Table 5 and FIG. 7.

TABLE 5

| Proportion of Water to Acetone (%) | Sulfur Content (ppm) |
|---|---|
| 1 | 497.9 |
| 2 | 332.8 |
| 4 | 381.3 |
| 6 | 394.2 |
| 8 | 394.0 |
| 10 | 409.7 |
| 15 | 554.6 |
| 20 | 678.1 |
| 30 | 1126.3 |
| 50 | 1112.4 |
| 60 | 1320.0 |
| 70 | 1350.0 |
| 80 | 1430.0 |

[EXAMPLE 14]

15 ml of kerosine (sulfur content: 210 ppm) and 15 ml of acetone were added to a 30 ml graduated cylinder with a stopper, and then agitated at intervals of 5 minutes for 30 minutes while applying thereto ultrasonic waves, followed by addition thereto of water and subsequent agitation. The resulting mixture was allowed to stand for a whole day and night. Thereafter, the oil layer was collected, washed with water, and dried. The influence of the proportion of water to acetone is shown in Table 6 and FIG. 8.

[EXAMPLE 15]

15 ml of gasoline (sulfur content: 52.31 ppm) and 15 ml of acetone were added to a 30 ml graduated cylinder with a stopper, and then agitated at intervals of 5 minutes for 30 minutes while applying thereto ultrasonic waves, followed by addition thereto of water and subsequent agitation. The resulting mixture was allowed to stand for a whole day and night. Thereafter, the oil layer was collected, washed with water, and dried. The influence of the proportion of water to acetone is shown in Table 7 and FIG. 9.

TABLE 6

| Proportion of Water to Acetone (%) | Sulfur Content (ppm) |
|---|---|
| 4 | 17.61 |
| 6 | 18.26 |
| 8 | 19.10 |
| 10 | 19.15 |
| 15 | 18.80 |
| 20 | 20.19 |
| 30 | 19.88 |

TABLE 6-continued

| Proportion of Water to Acetone (%) | Sulfur Content (ppm) |
|---|---|
| 50 | 20.90 |

TABLE 7

| Proportion of Water to Acetone (%) | Sulfur Content (ppm) |
|---|---|
| 6 | 37.85 |
| 8 | 42.64 |
| 10 | 45.09 |
| 15 | 40.70 |
| 20 | 41.34 |
| 30 | 39.36 |
| 50 | 42.67 |

[EXAMPLE 16]

300 g of straight-run bottoms (sulfur content: 44,200 ppm) were fed into the reaction tank 5, to which 300 ml of acetone and 6 ml of water were added. They were heated to 50° C., and then agitated and mixed together for 30 seconds with the propeller agitator 3 run at 2,000 rpm to prepare a liquid mixture. Thereafter, the liquid mixture was allowed to stand still until it was cooled to room temperature (20° C.). Acetone containing organic sulfur compounds and separated in the upper layer from the liquid mixture was collected. The foregoing procedure was repeated 6 times. Thereafter, 6 batches of the separated acetone containing the organic sulfur compounds were subjected to centrifugal separation with the centrifugal separator 8 run at 3,000 rpm to be stripped of tar, and then subjected to distillation at a temperature of 60° C. to recover the organic sulfur compounds as the distillation residue. The sulfur content of the treated bottoms was 1,260 ppm, and the recovery of the organic sulfur compounds contained in bottoms was 97% in terms of sulfur.

[EXAMPLE 17]

300 g of straight-run bottoms (sulfur content: 44,200 ppm) were fed into the reaction tank 5, to which 270 ml of ethanol and 30 ml of mesityl oxide were added. They were heated to 60° C., and then agitated and mixed together for 60 seconds with the propeller agitator 3 run at 3,000 rpm to prepare a liquid mixture. Thereafter, the liquid mixture was cooled to 10° C. The solvent containing organic sulfur compounds and separated in the upper layer from the liquid mixture was collected. The foregoing procedure was repeated 7 times. Thereafter, 7 batches of the separated solvent containing the organic sulfur compounds were subjected to distillation at a temperature of 130° C. to recover the organic sulfur compounds as the distillation residue. The sulfur content of the treated bottoms was 1,820 ppm, and the recovery of the organic sulfur compounds contained in bottoms was 96% in terms of sulfur.

[EXAMPLE 18]

300 cc of straight-run heavy gas oil (HGO, sulfur content: 17,000 ppm) was fed into the reaction tank 5, and heated to 50° C. 300 cc of acetone was then fed into the reaction tank 5 while agitating the contents thereof with the propeller agitator 3 run at 1,000 rpm, followed by further agitation for 30 seconds. Thereafter, the resulting liquid mixture was allowed to stand still for 5 minutes. The solvent containing organic sulfur compounds and oil and separated in the upper layer on the lower layer of deposited Heavy Oil A was collected, admixed with 1% of water, and agitated at 1,000 rpm for 30 seconds. Thereafter, the resulting mixture was allowed to stand still for 10 minutes. The solvent containing the organic sulfur compounds in the upper layer on deposited Oil B was collected, and then cooled to −5° C. The solvent containing the organic sulfur compounds in the upper layer on the lower layer of deposited Oil C was separated. Oil A, Oil B and Oil C were respectively subjected to 7 times of repeated heating, admixture with the same amount of acetone, agitation and cooling, and then combined together as desulfurized oil. The sulfur content of the treated HGO was 680 ppm, and the recovery of the organic sulfur compounds contained in HGO was 96% in terms of sulfur.

[EXAMPLE 19]

300 g of vacuum-distilled gas oil (VGO, sulfur content: 24,000 ppm) was fed into the reaction tank 5, and heated to 50° C. 300 cc of acetone was then fed into the reaction tank 5 while agitating the contents thereof with the propeller agitator 3 run at 1,000 rpm, followed by further agitation for 30 seconds. Thereafter, the resulting liquid mixture was allowed to stand still for 5 minutes. The solvent containing organic sulfur compounds and oil and separated in the upper layer on deposited Heavy Oil A was collected, admixed with 1% of water, and agitated for 30 seconds with an agitator run at 1,000 rpm. Thereafter, the resulting mixture was allowed to stand still for 5 minutes. The solvent containing the organic sulfur compounds in the upper layer on deposited Oil B was collected, and then cooled to −5° C. Oil C slightly lighter than Oil B was obtained in the lower layer, and the solvent containing the organic sulfur compounds in the upper layer was collected. Oil A, Oil B and Oil C were respectively subjected to 7 times of repeated heating, admixture with the same amount of acetone, agitation, cooling and solvent separation. Thereafter, Oil A, Oil B and Oil C were combined together to obtain desulfurized VGO. The sulfur content of the treated VGO was 720 ppm, and the recovery of the organic sulfur compounds contained in VGO was 97% in terms of sulfur.

What is claimed is:

1. A process for recovering organic sulfur compounds from a fuel oil, comprising admixing a fuel oil containing organic sulfur compounds with a solvent low in solubility therein of hydrocarbons and high in solubility therein of organic sulfur compounds to effect migration of said organic sulfur compounds contained in said fuel oil into said solvent;

then separating the solvent containing said organic sulfur compounds from the liquid mixture of said fuel oil and said solvent through at least one of settling out, osmosis, filtration and centrifugal separation; and subsequently evaporating said solvent to recover said organic sulfur compounds as the evaporation residue, wherein said solvent consists essentially of acetone admixed with a small quantity of water up to 5% by weight, based on said acetone, and optionally an acid or iodine incorporated thereinto in a concentration of at most 10% by weight.

2. A process for recovering organic sulfur compounds from a fuel oil as claimed in claim 1, wherein said fuel oil consists essentially of light oil.

3. A process according to claim 1 wherein said solvent is substantially free of said optional acid and said optional iodine.

4. A process according to claim 1 wherein said solvent contains at least one of said optional acid and said optional iodine.

5. A process for recovering organic sulfur compounds from a fuel oil as claimed in claim 1, wherein said liquid mixture in the form of a solution of said fuel oil admixed with said solvent is cooled to coagulate and aggregate said fuel oil dissolved in said solution to separate said fuel oil from said solvent containing said organic sulfur compounds.

6. A process for recovering organic sulfur compounds from a fuel oil as claimed in claim 1, wherein the recovered organic sulfur compounds are in a state of maintaining the original chemical structures of said organic sulfur compounds as contained in light oil and/or heavy oil.

7. A process according to claim 1 wherein said fuel oil is a light oil, heavy oil or a mixture thereof.

* * * * *